US006908890B2

(12) United States Patent
Oldenhove

(10) Patent No.: US 6,908,890 B2
(45) Date of Patent: Jun. 21, 2005

(54) PEARLESCENT SOLUTION

(75) Inventor: Louis Oldenhove, Liege (BE)

(73) Assignee: Colgate-Palmolive Company, New York, NY (US)

( * ) Notice: Subject to any disclaimer, the term of this patent is extended or adjusted under 35 U.S.C. 154(b) by 6 days.

(21) Appl. No.: 10/440,898

(22) Filed: May 19, 2003

(65) Prior Publication Data

US 2004/0235690 A1 Nov. 25, 2004

(51) Int. Cl.[7] ..... C11D 17/08
(52) U.S. Cl. ..... 510/159
(58) Field of Search ..... 510/130, 136, 510/139, 158, 159

(56) References Cited

U.S. PATENT DOCUMENTS 2,503,280 A 4/1950 Lockwood
2,507,088 A 5/1950 Bradley
3,260,744 A 7/1966 Ito et al.
3,320,174 A 5/1967 Rubinfeld
3,372,188 A 3/1968 Alston et al.
3,920,883 A * 11/1975 Yamada et al. ..... 514/762
4,115,315 A * 9/1978 Marinelli ..... 428/402.2
4,767,741 A * 8/1988 Komor et al. ..... 512/3
6,077,520 A * 6/2000 Tominaga ..... 424/401
6,270,782 B1 * 8/2001 Sawyer et al. ..... 424/401

FOREIGN PATENT DOCUMENTS

JP 2000239119 A * 9/2000 ..... A61K/7/00

* cited by examiner

*Primary Examiner*—Michael Barr
*Assistant Examiner*—John M. Petruncio
(74) *Attorney, Agent, or Firm*—Bernard Lieberman

(57) ABSTRACT

A pearlescent solution containing a metal oxide coated mica.

8 Claims, No Drawings

PEARLESCENT SOLUTION

FIELD OF THE INVENTION

The present invention relates to a liquid cleaning composition which contains suspended liquid beads which have a pearl-like appearance.

BACKGROUND OF THE INVENTION

Dual phase liquid composition which are essentially non-aqueous have been previously disclosed but aqueous compositions containing suspended liquid beads having a pearl-like appearance have not been disclosed.

U.S. Pat. No. 3,920,883 discloses a cosmetic composition containing an oil phase in the form of a dispersion of spheres or droplets, in a homogeneous mixture of organic solvent and water. This patent utilizes finely divided solid particles in the liquid composition to provide to the oil spheres a pearl-like appearance. U.S. Pat. No. 4,767,741 discloses a two-phase liquid composition which also contains a dispersion of oil phase spheres or droplets in an essentially organic solvent to produce a cosmetic having an aesthetically desirable appearance. This patent also utilizes finely divided solid particles. These particles are the result of precipitated salts in the composition. U.S. Pat. No. 6,270,782 entitled Body Spray Composition With Pearl-Like Oil Phase Droplets In Container discloses a body spray in an assembly comprising a container having a spray mechanism. The composition includes a water/organic solvent phase and dispersed oil phase under the form of oil droplets or spheres which have a pearl-like appearance. The composition includes finely divided particles in the form of one or more pigments which could contribute to the formation of the stable droplets and give them a pearl-like appearance.

A moisturizing composition containing "pearls" of oil droplets is available from Yves Rocher and is known as "Les Huiles Essentielles" or "Body Therapy with Sage & Mint". This product is provided in a glass bottle having a stopper and is shaken before using to disperse the oil droplets into the rest of the liquid composition.

SUMMARY OF THE INVENTION

The present invention relates to dual phase cleaning composition which comprises a nonaqueous liquid phase containing a coated mica and an organic oil and an aqueous liquid phase containing water, an aqueous cosolvent and an alkali metal salt, wherein the first nonaqueous liquid phase is suspended in the aqueous liquid phase such that the cleaning composition exhibits a pearl-like appearance.

The present teaches a method of creating dual-phase liquid compositions with superior aesthetics and containing suspended liquid beads which have a pearl-like appearance, wherein the dispersed phase contains essentially oily components and the continuous phase is essentially aqueous. The bead size is controlled by the presence of mica particles at the dispersed/continuous phase interface. Special colors and pearlescent effects can be conferred to the beads by using various mica grades based on natural mineral mica and coated with a thin layer made of metal(s) oxide(s).

DETAILED DESCRIPTION OF THE INVENTION

The present invention a dual phase liquid cleaning composition having a pearl-like appearance, wherein the composition comprises approximately by weight:

(a) 5% to 70%, more preferably 15% to 35% of an oil;

(b) 0.01% to 2%, more preferably 0.03% to 0.5% of a pearlescent pigment;

(c) 0 to 5%, more preferably 0.02% to 0.5% of a salting out salt;

(d) 0.01% to 20%, more preferably 0.25% to 3% of a cosolvent; and (e) the balance being water at a concentration of 30 wt. % to 95% of the total composition.

The oils used in the instant compositions must be liquid at room temperature and have a density close to 1.0 grams/ml and must be insoluble or sparingly soluble in water; and the preferred density range of the oil is 1.0 to 1.1 grams/liter.

The oil can be selected from the group consisting of organic diesters such as diethyl oxalate, dipropyl oxalate, dimethyl malonate, diethyl malonate, dipropyl malonate, dimethyl maleate, diethyl maleate, dipropyl maleate, diethyl fumarate, dimethyl succinate, diethyl succinate, ethyl methyl carbonate, 2-isopropylphenol, 2-ethylphenol, 2-propylphenol, benzeneethanol, 4-allyphenol, propylbenzoate, 2-allylphenol, 3-ethylphenol, ethylphenylacetate, 1.2-dimethoxy-4-allylbenzene, ethylbenzoate, dibenzyl ether, cyclohexyl benzoate, methylphenylacetate, dibutylphthalate, 1,4-butanediol diacetate, ethyl trans-cinnamate, cinnamaldehyde, ethylene glycol dimethacrylate, benzylacetate, 2,5-dimethylphenyl acetate, 3,5-dimethylphenyl acetate, dimethyl carbonate, isobutyl salicylate, eugenol or 4-ally-2-methoxyphenol, 1,1 ethanediol diacetate, methylbenzoate, 2-phenoxyethanol, ethyl 4-methoxy benzoate, diethylene glycol diacetate, ethylbenzoyl acetate, diethyl isophthalate, myristicin, . . . etc); other water insoluble or poorly water soluble oils such as some organosilicones (e.g. polydimethyl siloxanes derivatives), fluoro-compounds, etc.

The cosolvent is used in the instant composition to adjust phases densities so as to insure beads sphericity by an artificial zero-gravity as well as beads position in the liquid at rest (bottom or top). For example, in the example the glycerol partition coefficient is in favor of the aqueous phase; therefore, its purpose is to increase continuous phase density. Other cosolvents used to increase the continuous phase density are ethylene glycol, propylene glycol, butylene glycol, triethylene glycol, tetraethylene glycol, ethylene glycol diacetate, triethylene glycol diacetate, diethylene glycol monoethyl ether, other glycol ethers, formic acid, acetic acid, acrylic acid, dioxane, propylene carbonate, ethanol amine, diethanol amine, and triethanol amine.

Although not liquid at RT, other water-soluble materials could advantageously be considered to replace the above cosolvents to adjust the continuous phase density. These cosolvents are various polyols such as sorbitol, mannitol, galactitol, mono- and di-saccharides such as sorbose, lactose, raffinose, glucose, mannose, derivatives such as $\alpha$-methyl glucoside; amino acids such as glycine, valine, alanine, leucine, serine and asparagine; organic acids and their derivatives such as glutaric acid, quinic acid, maleic acid, citric acid, malonic acid, methyl malonic acid, methyl succinic acid, ascorbic acid, oxalic acid, and tartaric acid; ethylene carbonate, urea, methylurea, diethyl urea, and butyrolactam and mixtures thereof.

The pearlescent pigments employed in the instant composition are platelets of mineral mica which is muscovite or potassium aluminum hydroxide fluoride. The platelets of mica are coated with a thin layer of metal oxide selected from the group consisting of rutile titanium dioxide, ferric oxide and tin oxide and mixtures thereof. The coated platelets of mica have a particle size of about 2 to about 130 $\mu$m, more preferably about 10 to about 50 $\mu$m. The pearlescent pigment comprises about 30 wt. % to 75 wt. %, more preferably 35 wt. % to 72 wt. % of mica; about 20 wt. % to about 70 wt. %, more preferably about 25 wt. % to about 67 wt. % of rutile titanium dioxide, 0 to about 6 wt. %, more preferably about 0.25 wt. % to about 5 wt. % of ferric oxide and 0 to about 1.3 wt. %, more preferably about 0.1 wt. % to about 1.1 wt. % of tin oxide.

Preferred pearlescent pigments manufactured by Engelhard are Mearlin H-Lite Sparkle Blue®, Mearlin Sparkle Gold®, Mearlin Magna Pearl 1000®, and Lumina Turquoise®. Preferred pearlescent pigments manufactured by Merck are Iriodin 223 Rutile Fine Lilac®, Iriodin 7225 Ultra Blue® and Iriodin 7219 Ultra Lilac®.

The salting out salt which is an alkali or alkaline earth metal salt is selected from alkali metal or alkaline earth metal sulfates, carbonates, sulfites, phosphates, fluorides, chloride, bromides, nitrates, iodides and thiocyanates. A preferred salting out salt is sodium chloride.

The instant compositions can optionally contain 0 to 5 wt. %, more preferably 0 to 0.2 wt. % of a surfactant which is selected from the group consisting of $C_{12}$–$C_{14}$ fatty acid alkanol amide, ethoxylated nonionic surfactants, anionic surfactants and zwitterionic surfactants and mixtures thereof.

The water soluble nonionic surfactants which is utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to ??? moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91–8), $C_{12-13}$ alkanol condensed with 6.5 moles ethylene oxide (Neodol 23–6.5), $C_{12-15}$ alkanol condensed with 12 moles ethylene oxide (Neodol 25–12), $C_{14-15}$ alkanol condensed with 13 moles ethylene oxide (Neodol 45–13), and the like. Such ethoxamers have an HLB (hydrophobic lipophilic balance) value of 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The anionic surfactants which may be used in the nonionic based liquid detergent of this invention are water soluble such as triethanolamine and include the sodium, potassium, ammonium and ethanolammonium salts of $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates; alpha olefin sulfonates containing about 10–24 carbon atoms; $C_8$–$C_{18}$ alkyl sulfoacetates; $C_8$–$C_{18}$ alkyl sulfosuccinate esters; $C_8$–$C_{18}$ acyl isethionates; and $C_8$–$C_{18}$ acyl taurates. Preferred anionic surfactants are the water soluble $C_{12}$–$C_{16}$ alkyl sulfates, the $C_{10}$–$C_{15}$ alkylbenzene sulfonates, the $C_{13}$–$C_{17}$ paraffin sulfonates and the alpha $C_{12}$–$C_{18}$ olefin sulfonates.

The higher alkyl mononuclear aromatic sulfonates, such as the higher alkylbenzene sulfonates containing 9 to 18 or preferably 9 to 16 carbon atoms in the higher alkyl group in a straight or branched chain. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

Examples of suitable other sulfonated anionic detergents are the well known. The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains.

Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

The $C_{8-18}$ ethoxylated alkyl ether sulfate surfactants have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The $C_{12}$–$C_{20}$ paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent 735,096. Such compounds may be made to specifications and desirably the content of paraffin sulfonates outside the $C_{14-17}$ range will be minor and will be minimized, as will be any contents of di- or poly-sulfonates.

The present invention can also contain an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The long chain fatty acids are the higher aliphatic fatty acids having from about 8 to 22 carbon atoms, more preferably from about 10 to 20 carbon atoms, and especially preferably from about 12 to 18 carbon atoms, and especially preferably from 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources, such as tallow fatty acid, coco fatty acid, soya fatty acid, mixtures of these acids, etc. Stearic acid and mixed fatty acids, e.g. stearic acid/palmitic acid, are preferred.

Thus, examples of the fatty acids include, for example, decanoic acid, dodecanoic acid, palmitic acid, myristic acid, stearic acid, behenic acid, oleic acid, eicosanoic acid, tallow fatty acid, coco fatty acid, soya fatty acid, mixtures of these acids, etc. Stearic acid and mixed fatty acids, e.g. stearic acid/palmitic acid, are preferred.

The water-soluble zwitterionic surfactant, which can also be used, provides good foaming properties and mildness. The zwitterionic surfactant is a water soluble betaine having the general formula:

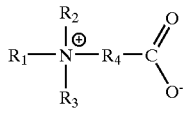

wherein $R_1$ is an alkyl group having 10 to 20 carbon atoms, preferably 12 to 16 carbon atoms, or the amido radical:

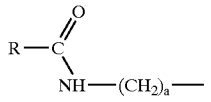

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia) acetate, coco dimethyl betaine or 2-(N-coco N,N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

Amine oxide semi-polar nonionic surfactants comprise compounds and mixtures of compounds having the formula:

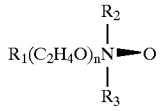

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

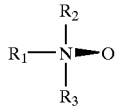

wherein $R_1$ is a $C_{12-16}$ alkyl, or an amido radical such as coco ($C_8$–$C_{18}$) amidopropyl, and $R_2$ and $R_3$ are methyl or ethyl. The above ethylene oxide condensates, amides, and amine oxides are more fully described in U.S. Pat. No. 4,316,824 which is hereby incorporated herein by reference.

The instant composition can contain a mixture of a $C_{12-14}$ alkyl monoalkanol amide such as lauryl monoalkanol amide and a $C_{12-14}$ alkyl dialkanol amide such as lauryl diethanol amide or coco diethanol amide.

The following composition in wt. % was prepared by two premixes and mixing them together at 25° C. in a beaker:

| | A | B | C | D | E | F | G |
|---|---|---|---|---|---|---|---|
| Premix 1 (19.73 wt. % of total composition) | | | | | | | |
| Diethyl adipate | 99.645 | 99.645 | 99.645 | 99.645 | 99.645 | 99.645 | 99.645 |
| Mearlin ® Hi-Lite Sparkle Blue Mica | 0.355 | | | | | | |
| Mearlin ® Sparkle Gold | | 0.355 | | | | | |
| Mearlin ® Magna Pearl | | | 0.355 | | | | |
| Lumina ™ Turquoise | | | | 0.355 | | | |
| Iriodin ® 223 Rutile Fine Lilac | | | | | 0.355 | | |
| Iriodin ® 7225 Ultra Blue | | | | | | 0.355 | |
| Iriodin ® 7219 Ultra Lilac | | | | | | | 0.355 |
| Premix 2 (80.27 wt. % of total composition) | | | | | | | |
| Water | 97.882 | 97.882 | 97.882 | 97.882 | 97.882 | 97.882 | 97.882 |
| Sodium chloride | 0.374 | 0.374 | 0.374 | 0.374 | 0.374 | 0.374 | 0.374 |
| Glycerol | 1.744 | 1.744 | 1.744 | 1.744 | 1.744 | 1.744 | 1.744 |
| Appearance | Pearl like | Pearl like | Pearl like | Pearl like | Pearl like | Pearl like | Pearl like |

What is claimed:

1. A pearlescent dual phase cleaning composition which comprises approximately by weight:

(a) 5% to 35% of an oil wherein said oil is an organic diester;

(b) 0.01% to 2% of a pearlescent pigment;

(c) 0.01% to 3% of a cosolvent; and (d) the balance being water, wherein the composition comprises an aqueous phase and a nonaqueous phase containing said oil.

2. The solution according to claim 1 wherein said pearlescent pigment is mica coated with a metal oxide.

3. The solution according to claim 2 wherein said metal oxide is selected from the group consisting of titanium oxide, ferric oxide and tin oxide and mixtures thereof.

4. The solution according to claim 2 wherein said oil is liquid at room temperature and has a density of 1.0 to 1.1 grams/liter.

5. The solution according to claim 4 wherein said cosolvent is selected from the group of glycols, glycerol, formic acid, acetic acid, acrylic acid, ethanol amines and dioxanes and mixtures thereof.

6. The solution according to claim 1, further including a salting out salt.

7. The solution according to claim 5 wherein said salting out salt is an alkali metal salt or an alkaline metal salt.

8. The solution according to claim 1 further including a surfactant.

* * * * *